US007598868B2

(12) United States Patent
Lee et al.

(10) Patent No.: US 7,598,868 B2
(45) Date of Patent: Oct. 6, 2009

(54) METHODS AND SYSTEMS FOR MONITORING COMPONENTS USING RADIO FREQUENCY IDENTIFICATION

(75) Inventors: Donald B. Lee, Shoreline, WA (US); Trevor M. Laib, Woodinville, WA (US)

(73) Assignee: The Boeing Company, Chicago, IL (US)

( * ) Notice: Subject to any disclaimer, the term of this patent is extended or adjusted under 35 U.S.C. 154(b) by 265 days.

(21) Appl. No.: 11/532,823

(22) Filed: Sep. 18, 2006

(65) Prior Publication Data

US 2007/0063847 A1 Mar. 22, 2007

Related U.S. Application Data

(60) Provisional application No. 60/719,318, filed on Sep. 21, 2005.

(51) Int. Cl.
*G08B 13/14* (2006.01)

(52) U.S. Cl. ..... 340/572.1; 200/61.93; 235/35; 235/36; 235/37

(58) Field of Classification Search ... 340/572.1–572.9, 340/545.2, 545.7, 545.6, 545.8, 545.9; 200/61.93; 232/35–37

See application file for complete search history.

(56) References Cited

U.S. PATENT DOCUMENTS

| | | | | |
|---|---|---|---|---|
| 5,450,615 | A | 9/1995 | Fortune et al. | |
| 5,525,994 | A * | 6/1996 | Hurta et al. | 342/51 |
| 5,805,082 | A * | 9/1998 | Hassett | 340/928 |
| 6,127,938 | A * | 10/2000 | Friedman | 340/693.6 |
| 6,204,764 | B1 | 3/2001 | Maloney | |
| 6,799,187 | B2 | 9/2004 | Beggs et al. | |
| 6,834,248 | B1 | 12/2004 | Green et al. | |
| 6,898,489 | B1 | 5/2005 | Hayes, Sr. | |
| 6,930,820 | B1 | 8/2005 | Shooks, Jr. et al. | |
| 7,348,884 | B2 * | 3/2008 | Higham | 340/572.1 |
| 7,388,501 | B2 * | 6/2008 | Tang et al. | 340/572.7 |

(Continued)

FOREIGN PATENT DOCUMENTS

GB 2 112 981 A 7/1983

(Continued)

OTHER PUBLICATIONS

Search Report of patent application GB00618634.0; Dec. 18, 2006; 1 page.

(Continued)

*Primary Examiner*—Davetta W Goins
*Assistant Examiner*—Edny Labbees
(74) *Attorney, Agent, or Firm*—Armstrong Teasdale LLP

(57) ABSTRACT

Methods and systems for a monitoring system for a vehicle are provided. The system includes at least one radio frequency identification (RFID) system comprising at least one transceiver and a plurality of RFID tags, the tags coupled to a plurality of vehicle components, a plurality of vehicle component retaining assemblies coupled to the plurality of components and operatively configured to substantially shield the amount of radio frequency (RF) energy received from the transceiver by each tag in a first position and unshield each tag in a second position, and an alert system for receiving information regarding the plurality of vehicle components and for generating an alert based on the information received.

29 Claims, 5 Drawing Sheets

U.S. PATENT DOCUMENTS

| | | | | |
|---|---|---|---|---|
| 2001/0006368 | A1 | 7/2001 | Maloney | |
| 2002/0145520 | A1 | 10/2002 | Maloney | |
| 2003/0231020 | A1 | 12/2003 | Yonezawa et al. | |
| 2004/0074974 | A1 | 4/2004 | Senba et al. | |
| 2004/0095241 | A1 | 5/2004 | Maloney | |
| 2004/0224135 | A1 | 11/2004 | Krebs | |
| 2005/0104790 | A1 | 5/2005 | Duron | |
| 2005/0156739 | A1 | 7/2005 | Maloney | |
| 2005/0280512 | A1 | 12/2005 | Forster | |
| 2006/0187060 | A1 * | 8/2006 | Colby | 340/572.8 |
| 2007/0171056 | A1 * | 7/2007 | Beyer | 340/545.2 |
| 2008/0143524 | A1 * | 6/2008 | Marusak et al. | 340/545.8 |

FOREIGN PATENT DOCUMENTS

| | | | |
|---|---|---|---|
| WO | 2004/013785 | A2 | 2/2004 |

OTHER PUBLICATIONS

U.S. Appl. No. 11/530,664, filed Sep. 11, 2006, entitled, "System and Methods for Tracking Aircraft Components"; 49 pages.

* cited by examiner

METHODS AND SYSTEMS FOR MONITORING COMPONENTS USING RADIO FREQUENCY IDENTIFICATION

CROSS REFERENCE TO RELATED APPLICATIONS

This application claims the priority of U.S. Provisional Patent Application No. 60/719,318 entitled "System and Method for Conditional Door Latch and Sensor Status Using Radio Frequency Identification" filed Sep. 21, 2005, which is hereby incorporated by reference in its entirety.

BACKGROUND OF THE INVENTION

This invention relates generally to radio frequency identification (RFID) systems, and more particularly, to systems and methods for monitoring components using RFID systems.

Component monitoring for transportation vehicles, for example, airplanes, is essential to ensure safety, security, and operational readiness. At least some airlines rely on personnel to physically inspect doors, latches, and containers to verify their status and location. However, relying on the skill level of the inspector may result in errors and/or the expenditure of significant man hours. Currently, life vests can be detected on the airplane by attaching an RFID tag onto the vest. By this method, an RFID reader can detect the plurality of life vests on the airplane, and by counting, can determine that all required vests are on the plane. This does not determine that all vests are properly stowed, as stolen items placed in passengers' baggage are still detected. Further, numerous signals are received from all the RID tags attached to all the various types of equipment present, and the desired signals may be difficult to differentiate.

Currently, life vest tampering can be detected by placing a frangible RFID tag on the life vest pocket, such that removing the life vest destroys the RFID tag. Again, an RFID reader can detect the life vests on the airplane, and can, by counting, verify that all the required vests are present and not tampered with. In this case, a hand-held short range RFID tag reader can be used to find the tampered life vest pocket by looking for the absence of an RFID response from the tampered seat group. The stolen vest cannot be detected at all, and the problem of multiple signals remains.

Other airlines rely on elaborate system of wired sensors positioned throughout the airplane. Each door, latch, and component may be wired to visually or audibly to notify flight personnel regarding their status. However, wired systems add weight and complexity to the design of airplanes.

BRIEF DESCRIPTION OF THE INVENTION

In one embodiment, a system for monitoring a vehicle includes at least one radio frequency identification (RFID) system comprising at least one transceiver and a plurality of RFID tags, the tags coupled to a plurality of vehicle components, a plurality of vehicle component retaining assemblies coupled to the plurality of components and operatively configured to substantially shield the amount of radio frequency (RF) energy received from the transceiver by each tag in a first position and unshield each tag in a second position, and an alert system for receiving information regarding the plurality of vehicle components and for generating an alert based on the information received.

In another embodiment, a method for monitoring vehicle components includes coupling at least one RFID tag to at least one vehicle component, coupling at least one RFID transceiver configured to emit an RF energy within the vehicle to the at least one tag, shielding an amount of RF energy received by the at least one tag such that the at least one tag can not transmit to the at least one transceiver, and coupling an alert system for receiving information from the at least one transceiver.

In yet another embodiment, a monitoring system for a plurality of airplane components includes a radio frequency identification (RFID) system comprising at least one of a RFID tag and a RFID transceiver, each positioned within a fuselage of the airplane, said tag coupled to at least one of an airplane component, and at least one radio frequency (RF) energy shield extending circumferentially around said at least one RFID tag such that RF energy directed from said RFID transceiver is blocked or detuned when said at least one RF energy shield is in a first position.

DETAILED DESCRIPTION OF THE INVENTION

As used herein a shield refers to an object configured to interrupt, obstruct, or otherwise degrade or limit the effective performance of an RFID transponder assembly. Although many objects are capable of interrupting, obstructing, or otherwise degrading or limiting the effective performance of an RFID transponder assemblies, only items configured to perform this function are referred to as sheilds.

Many specific details of certain embodiments of the invention are set forth in the following description in order to provide a thorough understanding of such embodiments. One skilled in the art, however, will understand that the present invention may have additional embodiments, or that the present invention may be practiced without several of the details described in the following description.

Figure 1:
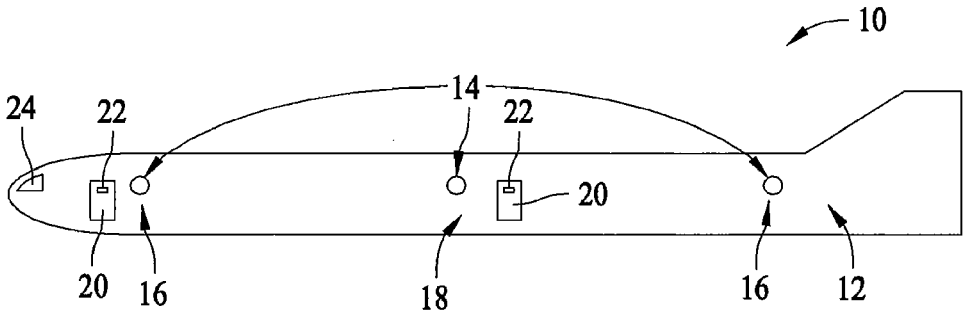
FIG. 1 is a schematic side view of an exemplary fuselage of an aircraft 10 in accordance with an embodiment of the present invention.

FIG. 1 is a schematic side view of an exemplary fuselage of an aircraft 10 in accordance with an embodiment of the present invention. Aircraft 10 includes an RFID component status monitoring system 12 that includes at least one RFID reader 14 positioned at a predetermined corresponding number of locations within aircraft 10. Typically such locations are a lavatory area 16 and a galley area 18. Additional readers 14 may be positioned at further locations depending upon the monitoring needs of a particular aircraft model or other type of vehicle. A plurality of aircraft access doors 20 includes respective latches 22 for maintaining access door closed and sealed during a flight. RFID component status monitoring system 12 includes an alert system 24 for receiving information regarding a plurality of vehicle components, for example, but not limited to, access doors 20, latches 22, and stowable components such as life jackets, and other personnel protective equipment, and for generating an alert based on the information received.

Figure 2:
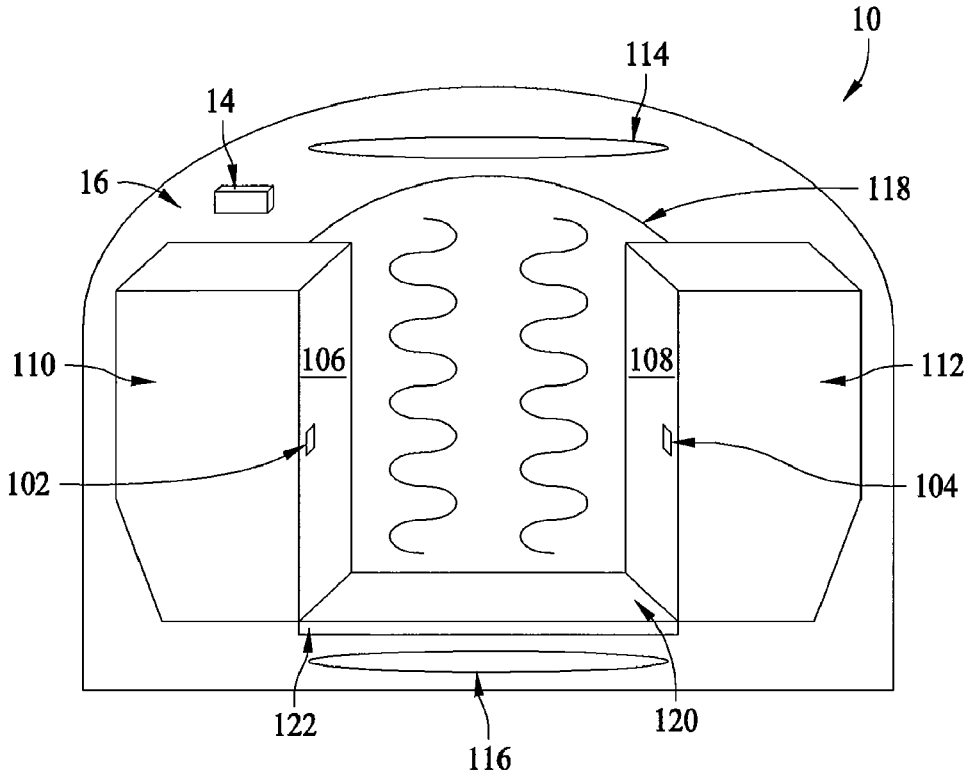
FIG. 2 is a perspective view of a portion of the RFID component status monitoring system shown in FIG. 1 that may be used to monitor a lavatory area.

FIG. 2 is a perspective view of a portion of RFID component status monitoring system 12 (shown in FIG. 1) that may be used to monitor lavatory area 16. In the exemplary embodiment, system 12 is configured to monitor an aircraft door latch status. Although FIG. 2 illustrates system 12 in the context of lavatory doors and latches, it is to be understood that the present invention is a system and method for reporting door, cabinet, and food cart latch status over a wireless link to the airplane avionics, eliminating the complex wiring and sensors used in traditional implementations providing a reduction in system complexity, wiring and weight.

In addition, some door latches are linked to signs indicating the status or condition of the door. System 12 includes a plurality of RFID tags 102, 104, each coupled to a respective door 106, 108 of a lavatory 110, 112. System 12 also includes RFID antennas 116, 114, and RFID reader 14 that are complementary to RFID tags 102, 104. In the exemplary embodiment, system 12 monitors a door latch status of each latch on a respective lavatory door 106, 108. The latch status drives occupied/unoccupied signage on an aircraft and also provides an indication to the aircraft avionics for situational awareness for both pilots and flight attendants. RFID reader 14 is located proximate to lavatory area 16 to be monitored. In the exemplary embodiment, RFID readers 14 are placed above the ceiling panels 118 and reader antennas 114 and 116 are incorporated into ceiling panels 118, under carpet 120, and/or into the laminate used on the monuments to be monitored. Because reader antennas 114, 116 are able to be manufactured out of etched metal, copper tape, or thin wire; they can easily be incorporated into the space between a floor panel 122 and carpet 120, and onto the backside of ceiling panels 118 or decorative laminates used on most monuments.

Figure 3A:
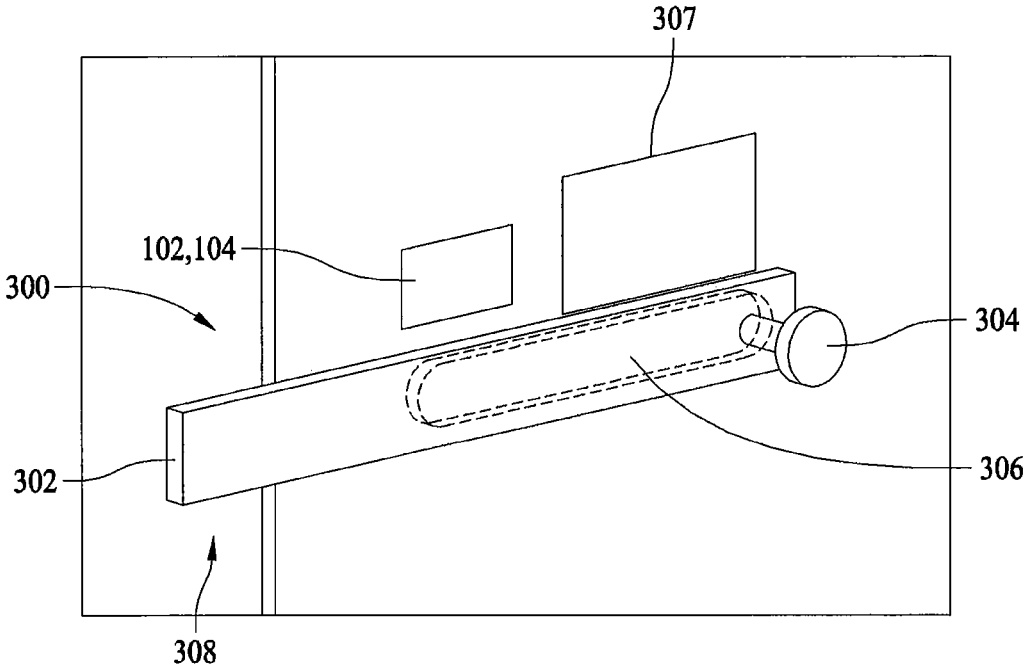
FIG. 3 is a perspective view of an exemplary latch that may be used with the lavatory area portion of the system shown in FIG. 2.
Figure 3B:
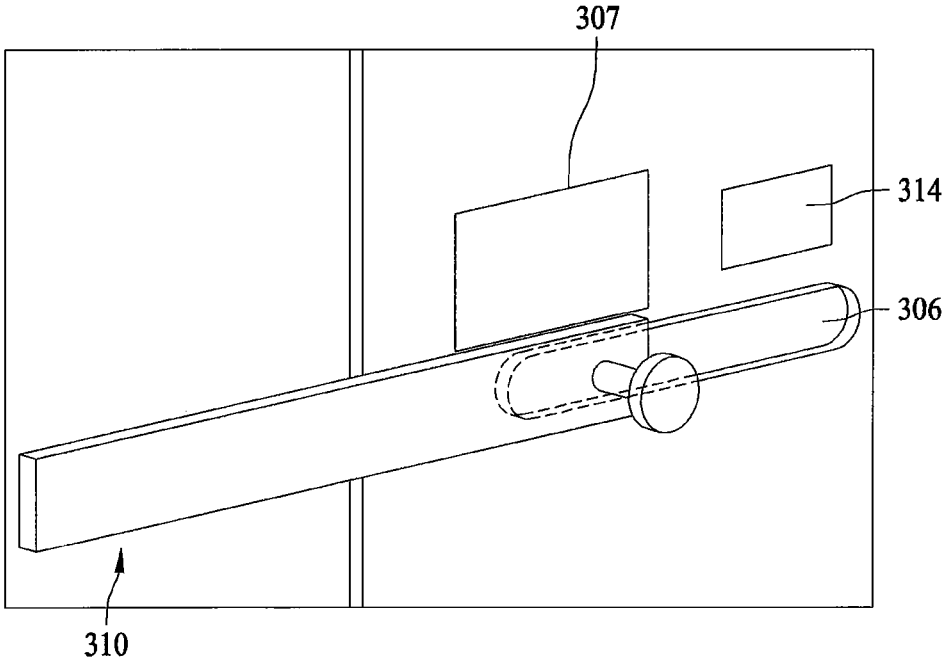

FIG. 3 is a perspective view of an exemplary latch 300 that may be used with the lavatory area 16 portion of system 12 (shown in FIG. 2). Latch 300 includes a bolt portion 302 configured to engage a slot (not shown) in a jamb (not shown) of door 106, 108. Bolt portion 302 is positioned within door 106, 108 adjacent a peripheral edge of door 106, 108. Bolt portion 302 is coupled to a knob 304 extending away from bolt portion 302 such that bolt 302 is actuated through a slot 306 in an inside surface of door 106, 108.

Bolt 302 includes a shield 307 extending from a side of bolt 302. Shield 307 blocks RF energy in the frequencies used by RFID tag 102, 104, for example, by creating a faraday cage. In another embodiment, shield 307 detunes the RFID tag antenna sufficiently to prevent normal function. Moreover, shield 307 may be formed from an RF-opaque material, for example, carbon fiber. Bolt 302 is translatable between a first unlatched position 308 and a second latched position 310. An RFID enabled component such as an RFID tag 102, 104 is coupled to door 106, 108 proximate latch 300 and in alignment with a path of shield 307 as bolt 302 is moved between first position 308 and second position 310.

In the exemplary embodiment, lavatory latch status is read without the traditional wiring and door contact sensors using RFID tag 102, 104 and shield 307. RFID tag 102, 104 is located adjacent the latch 300 such that tag 102, 104 is uncovered when bolt 302 is in position 308 and covered when bolt 302 is in position 310. Such configuration permits tag 102, 104 to receive enough energy to transmit only when RFID tag 102, 104 is in unlatched position 308.

An optional second RFID tag 314 is coupled to door 106, 108 proximate latch 300 and in alignment with a path of shield 307 as bolt 302 is moved between second position 310 and first position 308. The RFID tags transmit different codes such that system 12 recognizes the position of bolt 302 from the received code.

Figure 4:
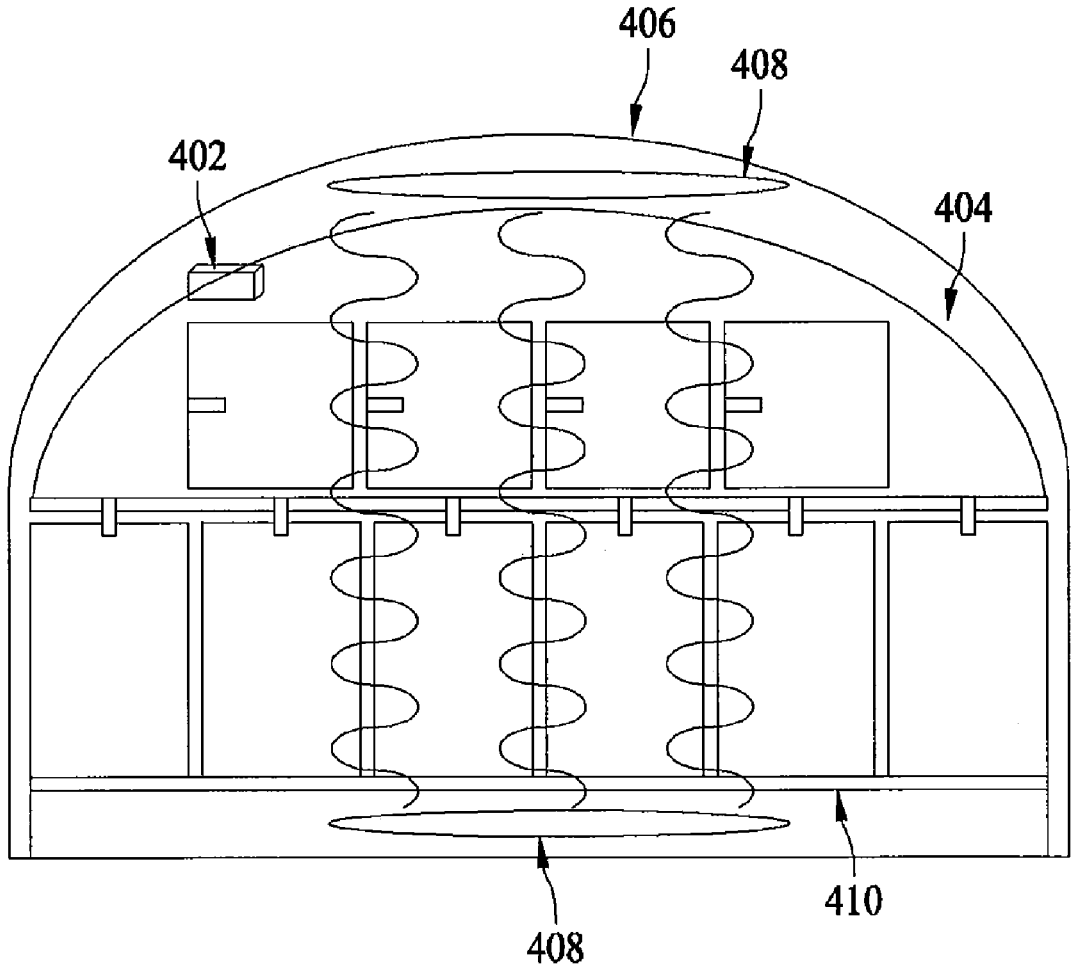
FIG. 4 is a perspective view of a portion of the RFID component status monitoring system shown in FIG. 1 that may be used to monitor a galley area.

FIG. 4 is a perspective view of a portion 400 of RFID component status monitoring system 12 (shown in FIG. 1) that may be used to monitor galley area 18. The galley area portion of system 12 includes a reader 402 mounted between an interior panel 404 and the skin 406 of aircraft 10. System 12 also includes one or more reader antenna 408, which may be positioned above interior panel 404 and/or under carpet 410.

Figure 5A:
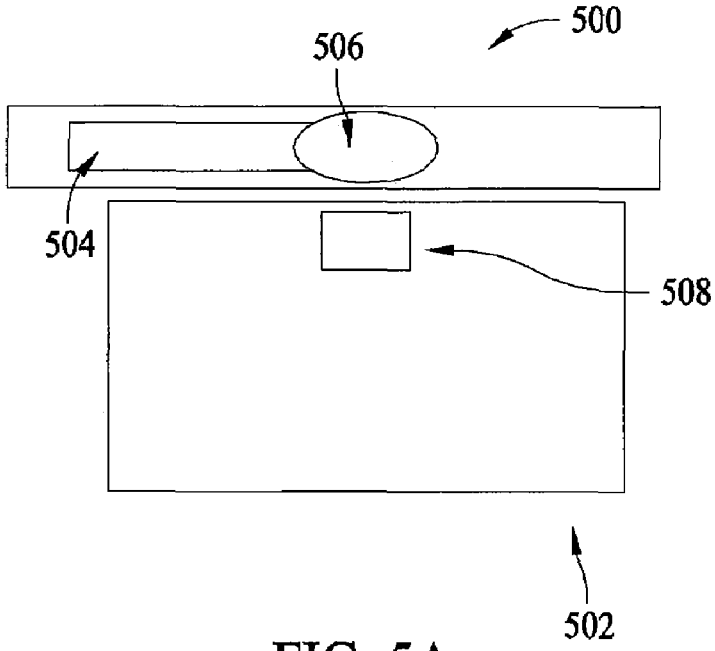
FIG. 5 is a perspective view of an exemplary latch that may be used with the galley area portion of system shown in FIG. 4.
Figure 5B:
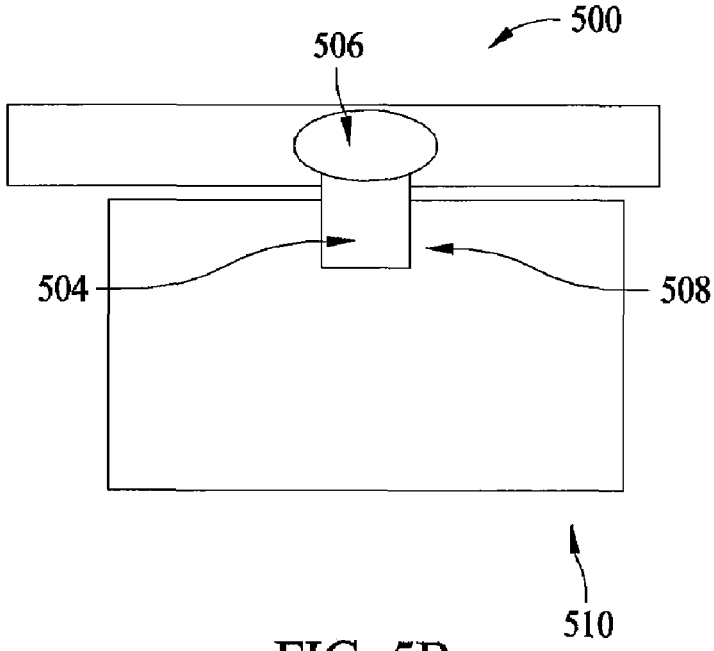

FIG. 5 is a perspective view of an exemplary latch 500 that may be used with the galley area 18 portion of system 12 (shown in FIG. 4). Food carts and cabinet latch status for galley area 18 is monitored using a galley area portion of system 12 that is substantially similar to the lavatory area portion of system 12 (shown in FIG. 2). In the exemplary embodiment, a standard food cart latch 500 includes a rotatable bolt 504 coupled to a knob 506 is used. An RFID enabled component such as an RFID tag 508 is coupled to a food cart 510 in a position where RFID tag 508 is uncovered by bolt 504 when bolt 504 is in a first unlatched position 508 and is covered by bolt 504 when bolt 504 is in a second latched position 510. In the exemplary embodiment, RFID tag 508 comprises a peel and stick substrate that is adhesively coupled to food cart 510. In various alternative embodiments, a shield plate is coupled to an edge of a door, such that an associated RFID tag is shielded or detuned when the door is in the closed position, and exposed to an RFID reader when the door is in the open position.

System 12 is also configured to detect a missing component such as a line replaceable unit (LRU), by placing a shield plate onto the edge of the LRU mounting tray, such that the RFID tag is shielded or detuned when the LRU is present, and exposed to an RFID reader when the LRU is removed or incompletely installed.

In an alternative embodiment, an unfastened seat belt can be detected if an RFID tag is placed in the one half of the buckle such that the RFID tag is shielded when the two halves of the buckle are joined together.

Figure 6:
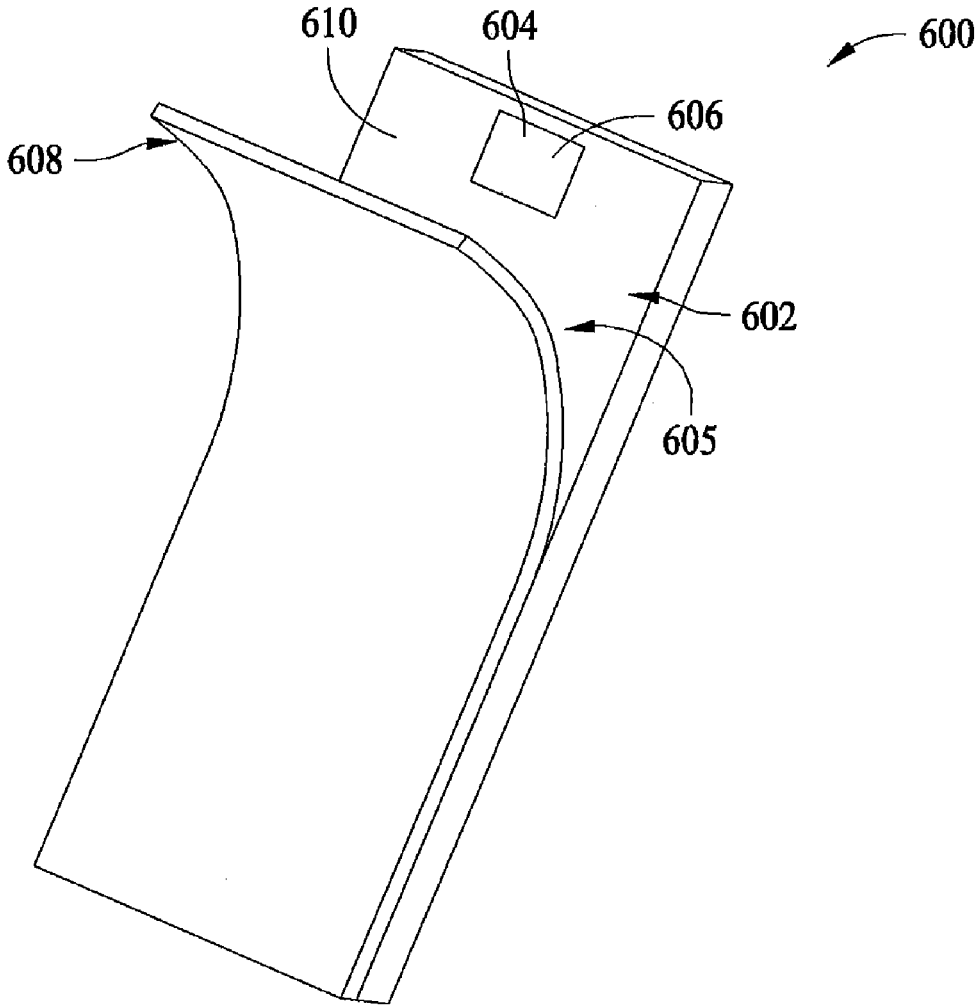
FIG. 6 is a perspective view of an exemplary RFID enabled tag that may be used with the various embodiments of the system shown in FIG. 1.

FIG. 6 is a perspective view of an exemplary RFID enabled tag 600 that may be used with the various embodiments of system 12 described above. In the exemplary embodiment, RFID enabled tag 600 includes a substrate 602. An RFID device 604 is coupled to a surface 605 of substrate 602. In an alternative embodiment, device 604 is coupled to a recess 606 formed in surface 605 of substrate 602. In another alternative embodiment, device 604 is embedded in an interior of substrate 602. RFID enabled tag 600 also includes a shield 608 coupled to surface 605. Shield 608 shields or detunes RFID device 604 from an RFID reader (not shown). In the exemplary embodiment, shield 608 is formed of a metallic foil that is weakly coupled to surface 605 using an adhesive 610 such that a pulling or shearing action between shield 608 and surface 605 would separate them and expose RFID device 604 to an RFID reader.

In another alternative embodiment, an improperly stowed device or missing device can be detected, such as a missing life preserver, fire extinguisher, life raft or other device by attaching an RFID tag to the carrying tray for the device, and a foil metal shield onto the device being protected. As described above, the RFID tag is shielded or detuned when the equipment is properly stowed, and exposed to an RFID tag reader when removed. Accordingly, system 12 permits an instantaneous high confidence test of the presence of life vests on the aircraft prior to an overseas flight, thus reducing aircraft turn time.

For removable or frequently stolen equipment like life vests, it may be desirable to attach the RFID tag to the equipment, and the shield onto the carrier. With this alternate method, a wide range RFID reader within the cabin detects the theft, and a hand held short range RFID reader detects the stolen equipment, wherever it has been hidden.

In an alternative embodiment, system 12 is configured detect exposure to solvents or water. For example, by manufacturing RFID tag 600 with adhesive 610 configured to de-bond and permit shield 608 to peel away from substrate 602 in the presence of the solvent or water, thereby exposing RFID device 604 to detection by a reader.

In another alternative embodiment, system 12 is configured detect exposure to high temperatures. For example, by manufacturing RFID tag 600 with adhesive 610 configured to de-bond and permit shield 608 to peel away from substrate 602 in the presence of high temperatures, thereby exposing RFID device 604 to detection by a reader.

The performance of the above described embodiments can be aided by the use of disbond promoters, which react with heat or solvents to push apart the two layers of substrate 602 and shield 608. For example, a heat-sensing disbond promoter includes water filled microspheres that burst when the temperature rises above a predetermined range. At least some known materials become brittle, or liberate gas when exposed to radiation.

In still another alternative embodiment such materials are used to form an RFID shield that disbonds after exposure to a predetermined dose of radiation. At least some known materials lose structural integrity when corroded. In yet another alternative embodiment such materials are used to form an RFID shield that is sensitive to corrosion.

In another embodiment, a mass is attached to shield 608 such that a mechanical shock or vibration above a predetermined level is detected by the shield disbonds above a certain acceleration rate. Such a device is particularly useful for detecting improper handling of sensitive equipment during shipping.

In another embodiment, a reusable heat detector includes a bimetallic strip configured to couple shield 608 to substrate 602 such that shield 608 is moved away from substrate 602 outside a predetermined temperature range, and moved back to a position covering substrate 602 and RFID device 604 when the temperature returns to the predetermined temperature range.

In another embodiment, a reusable pressure detector includes a gas-filled mechanism configured to couple shield 608 to substrate 602 such that shield 608 is moved away from substrate 602 outside a predetermined pressure range, and moved back to a position covering substrate 602 and RFID device 604 when the pressure returns to the predetermined pressure range.

The foregoing description of the exemplary embodiments of the invention are described for the purposes of illustration and are not intended to be exhaustive or limiting to the precise embodiments disclosed. Many modifications and variations are possible in light of the above teaching. It is intended that the scope of the invention be limited not with this detailed description, but rather by the claims appended hereto.

The above-described methods and systems for identifying aircraft component parts and for mistake proof aircraft maintenance is cost-effective and highly reliable. The system permits monitoring of a plurality of vehicle components without using costly and heavy hard-wired monitoring systems. Accordingly, the methods and systems described herein facilitate operation of vehicles including aircraft in a cost-effective and reliable manner.

Exemplary embodiments of systems for identifying aircraft component parts and for mistake proof aircraft maintenance are described above in detail. The components of these systems are not limited to the specific embodiments described herein, but rather, components of each system may be utilized independently and separately from other components described herein. Each components of each system can also be used in combination with other component identifying systems.

While the invention has been described in terms of various specific embodiments, those skilled in the art will recognize that the invention can be practiced with modification within the spirit and scope of the claims.

What is claimed is:

1. A monitoring system for a vehicle, said vehicle comprising a plurality of vehicle components, the system comprising:

at least one radio frequency identification (RFID) system comprising at least one transceiver and a plurality of RFID tags, a first RFID tag of said plurality of RFID tags coupled to a first vehicle component of said plurality of vehicle components, said first vehicle component positioned in one of a first position and a second position;

a plurality of radio frequency (RF) shields, a first RF shield of said plurality of RF shields operatively configured to substantially shield an amount of RF energy received from said transceiver by said first RFID tag when said first vehicle component is in the first position and configured not to shield said first RFID tag when said first vehicle component is in the second position; and an alert system for generating an alert when said first vehicle component is in the second position based on receipt of a data signal at the at least one transceiver from said first RFID tag.

2. A monitoring system in accordance with claim 1 wherein each of said plurality of RF shields is fabricated from at least one of an RF energy shielding material, an electromagnetic shielding material, and a microwave shielding material.

3. A monitoring system in accordance with claim 1 wherein each of said plurality of RF shields is fabricated from at least one of an electrically conductive material, a metallic material, and a liquid.

4. A monitoring system in accordance with claim 1 wherein each of said plurality of RF shields is fabricated from at least one of a bio-degradable material, a thermo-degradable material, and chemo-degradable material.

5. A monitoring system in accordance with claim 1 wherein said first RF shield is configured to limit an amount of RF energy received by said first RFID tag when said first vehicle component is in the first position such that said first RFID tag has insufficient power to send a data signal to said transceiver.

6. A monitoring system in accordance with claim 1 wherein each of said plurality of RFID tags includes vehicle component information including a status, a location, a time/date, and a serial number of at least one component associated with the RFID tag.

7. A monitoring system in accordance with claim 1 wherein at least one of said plurality of RFID tags is coupled to at least one container of components, said container tags include information corresponding to said components within said container.

8. A method for monitoring vehicle components, said method comprising:

coupling at least one RFID tag to at least one vehicle component, the at least one vehicle component including at least one vehicle component restraining assembly;

coupling a radio frequency (RF) shield to at least one of the vehicle component and the vehicle component restraining assembly;

configuring the RF shield to move between a first position and a second position relative to the RFID tag when the vehicle component restraining assembly moves between a first position and a second position relative to the vehicle component;

positioning at least one RFID transceiver proximate to the RFID tag, the at least one RFID transceiver configured to emit an RF energy within the vehicle for receipt by the RFID tag; and configuring an alert system to receive information from the RFID transceiver and to determine whether the vehicle component restraining assembly is in the first position or the second position relative to the vehicle component.

9. A method for monitoring in accordance with claim 8 wherein coupling at least one RFID tag further comprises coupling at least one RFID tag to a container comprising a plurality of components therein.

10. A method for monitoring in accordance with claim 8 wherein coupling at least one RFID tag further comprises coupling at least one RFID tag including data including a status, a location, a time/date, and a serial number of each component.

11. A method for monitoring in accordance with claim 8 wherein coupling at least one RFID transceiver further comprises coupling a plurality of transceivers each comprising a plurality of antennas such that a first antenna is positioned substantially above the at least one RFID tag and a second antenna is positioned substantially below the at least one RFID tag.

12. A method for monitoring in accordance with claim 8 wherein shielding an amount of RF energy further comprises configuring the RF shield to substantially shield the amount of radio frequency (RF) energy received from the transceiver by the at least one RFID tag when the at least one component restraining assembly is in the first position and unshield the at least one RFID tag when the at least one component restraining assembly is in the second position.

13. A method for monitoring in accordance with claim 12 wherein configuring the RF shield to substantially shield the amount of RF energy received from the transceiver further comprises fabricating the RF shield from at least one of an RF energy shielding material, an electromagnetic shielding material, a microwave shielding material, and an electrical shield material.

14. A method for monitoring in accordance with claim 8 wherein providing the at least one vehicle component restraining assembly with an RF shield comprises providing at least one of a latching mechanism for at least one of a lavatory door, a gallery door, and a container door with an RF shield.

15. A method for monitoring in accordance with claim 8 further comprising generating an alert when the at least one component restraining assembly is in the second position.

16. A method for monitoring in accordance with claim 15 wherein generating an alert further comprises alerting a user when the RFID transceiver receives a data signal from the at least one RFID tag.

17. A monitoring system for airplane components, said system comprising:

a radio frequency identification (RFID) system comprising at least one RFID tag and at least one RFID transceiver, said at least one RFID tag and said at least one RFID transceiver positioned within a fuselage of an airplane, said airplane comprising a plurality of airplane components, said at least one RFID tag coupled to at least one of said plurality of airplane components; and at least one radio frequency (RF) energy shield extending circumferentially around said RFID tag such that said RFID tag is shielded or detuned when said RF energy shield is in a first position relative to said RFID tag, one of said RFID tag and said RFID energy shield coupled to said airplane component such that the position of said RF energy shield relative to said RFID tag is dependent upon a position of said airplane component, wherein the position of said airplane component is determined by said RFID system based on information from said RFID tag received at said RFID transceiver.

18. A monitoring system in accordance with claim 17 wherein said RFID tag is not shielded or detuned when said RF energy shield is in a second position relative to said RFID tag, the second position allowing RF energy directed from said RFID transceiver to be received by said RFID tag.

19. A monitoring system in accordance with claim 18 further comprising an alert system configured to:

receive information from said RFID transceiver regarding a status of said RFID tag; and generate an alert when said RF energy shield is in the second position relative to said RFID tag.

20. A monitoring system in accordance with claim 17 wherein said RF energy shield is a latching mechanism slidably coupled to said airplane component such that said RFID tag is shielded in a closed or latched position and unshielded when in an open or unlatched position.

21. A monitoring system in accordance with claim 17 wherein said RFID tag includes information including a status, a location, a time/date, and a serial number of at least one airplane component.

22. A monitoring system in accordance with claim 17 wherein said RFID transceiver further comprises at least one antenna positioned in a ceiling portion of the fuselage and at least one antenna positioned in a floor portion of the fuselage such that said at least one RFID tag is positioned therebetween.

23. A monitoring system in accordance with claim 17 wherein said RFID tag is coupled to an airplane container comprising a plurality of airplane components, wherein said RFID tag includes information corresponding to said airplane container.

24. A monitoring system in accordance with claim 23 wherein said container further comprises at least one RFID transceiver antenna positioned adjacent an opening of said container.

25. A monitoring system in accordance with claim 17 wherein said RF energy shield is fabricated from at least one of an RF energy shielding material, an electromagnetic shielding material, a microwave shielding material, and an electrical shield material.

26. A monitoring system in accordance with claim 19 wherein said alert system is included within an airplane avionics system configured to alert airplane personnel when said RF energy shield is in the second position relative to said RFID tag.

27. A monitoring system in accordance with claim 1 wherein said first vehicle component is coupled to one of said first RFID tag and said first RF shield, said first RFID tag configured to move relative to said first RF shield when said first vehicle component is moved between the first position and the second position.

28. A method for monitoring in accordance with claim 8 further comprising configuring the RF shield to shield the RFID tag from RF energy emitted by the at least one transceiver when the RFID tag is in the first position relative to the RF shield and the vehicle component restraining assembly is in the first position relative to the vehicle component.

29. A method for monitoring in accordance with claim 8 further comprising configuring the RF shield to allow RF energy emitted by the at least one transceiver to be received at the RFID tag when the RFID tag is in the second position relative to the RF shield and the vehicle component restraining assembly is in the second position relative to the vehicle component.

* * * * *